US008860613B2

(12) United States Patent
Andrenko

(10) Patent No.: US 8,860,613 B2
(45) Date of Patent: Oct. 14, 2014

(54) PATCH ANTENNA

(71) Applicant: Fujitsu Limited, Kawasaki (JP)

(72) Inventor: Andrey S Andrenko, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 264 days.

(21) Appl. No.: 13/625,376

(22) Filed: Sep. 24, 2012

(65) Prior Publication Data

US 2013/0099982 A1 Apr. 25, 2013

(30) Foreign Application Priority Data

Oct. 19, 2011 (JP) ..... 2011-229604

(51) Int. Cl.

| | |
|---|---|
| ***H01Q 1/38*** | (2006.01) |
| ***H01Q 5/00*** | (2006.01) |
| ***H01Q 9/04*** | (2006.01) |
| ***H01Q 21/28*** | (2006.01) |
| *H01Q 1/27* | (2006.01) |

(52) U.S. Cl.

CPC ..... *H01Q 5/0072* (2013.01); *H01Q 9/0414* (2013.01); *H01Q 21/28* (2013.01); *H01Q 1/273* (2013.01)

USPC ..... 343/700 MS

(58) Field of Classification Search

CPC ..... H01Q 1/38; H01Q 9/0407; H01Q 9/0421; H01Q 1/243; H01Q 5/0003

USPC ..... 343/700 MS, 702, 841, 872, 846, 848, 343/853

See application file for complete search history.

(56) References Cited

U.S. PATENT DOCUMENTS

| | | | | |
|---|---|---|---|---|
| 5,519,406 | A * | 5/1996 | Tsukamoto et al. | 343/700 MS |
| 7,830,312 | B2 * | 11/2010 | Choudhury et al. | 343/700 MS |
| 8,730,106 | B2 * | 5/2014 | Parsche | 343/700 MS |
| 2003/0112187 | A1 * | 6/2003 | Whitehouse | 343/702 |
| 2003/0146872 | A1 | 8/2003 | Kellerman et al. | |
| 2010/0134378 | A1 | 6/2010 | Duchesne et al. | |
| 2010/0214192 | A1 * | 8/2010 | Chao | 343/906 |

FOREIGN PATENT DOCUMENTS

| | | |
|---|---|---|
| JP | 06-303028 | 10/1994 |
| JP | 2002-305409 | 10/2002 |
| JP | 2003-258540 | 9/2003 |
| JP | 2007-068096 | 3/2007 |
| JP | 2009-501467 | 1/2009 |

* cited by examiner

*Primary Examiner* — Huedung Mancuso
(74) *Attorney, Agent, or Firm* — Staas & Halsey LLP

(57) ABSTRACT

There is provided a patch antenna that includes a substrate, a ground electrode placed on the substrate, a first patch configured to be electrically conductive and placed above the ground electrode for transmitting or receiving a first frequency, a second patch configured to be electrically conductive and placed above the first patch for transmitting or receiving a signal of the second frequency, a dielectric member configured to be placed on the ground electrode and support the first patch and the second patch, a first conductor configured to be formed in a cylindrical shape, the first conductor being connected to the first patch and the ground electrode, a second conductor configured to be formed in a cylindrical shape, the second conductor being connected to the second patch and the ground electrode, a first feed line connected to the first patch, and a second feed line connected to the second patch.

4 Claims, 8 Drawing Sheets

PATCH ANTENNA

CROSS-REFERENCE TO RELATED APPLICATION

This application is based upon and claims the benefit of priority of the prior Japanese Patent Application No. 2011-229604, filed on Oct. 19, 2011, the entire contents of which are incorporated herein by reference.

FIELD

The embodiments discussed herein are related to patch antennas that may be used in a plurality of frequency bands.

BACKGROUND

In recent years, researches are being conducted on a body area network (BAN) in which communications are performed among a plurality of communication devices attached on different positions of a human body. BAN is expected to be used in, for example, health care applications. For example, wireless communications are conducted between a small communication device connected to a biological sensor attached to a certain portion of a human body such as, for example, a wrist and a controller attached to a different portion of the human body such as, for example, a torso thereby transmitting biological information obtained by the biological sensor to the controller. Then, the controller may transmit the biological information to, for example, a medical information management system installed in a medical institution through a wireless communication channel, together with identification information of a person who wears the controller or with controller's identification information.

As described above, in BAN, a communication device is attached to a human body. Accordingly, it is preferable that an antenna included in the communication device is small in size, and particularly preferable that the antenna has a smaller size in a direction perpendicular to a human body surface. Furthermore, in BAN, there may be cases where three or more communication devices are attached to a human body. In such cases, the communication devices each use a different frequency band. Accordingly, it is preferable that antennas included in communication devices used in BAN may be usable in a plurality of frequency bands.

On the other hand, patch antennas that are small in size and usable in a plurality of frequency bands are being proposed (for example, see Japanese Laid-open Patent Publications Nos. 2007-68096, 1994-303028, 2002-305409, 2003-258540 and Japanese National Publication of International Patent Application No. 2009-501467). The patch antennas disclosed in these patent documents each include a plurality of layered conductor plates (patches), and have better radiation characteristics in a direction perpendicular to surfaces of the conductors so as to make it usable in a global positioning system (GPS), for example.

SUMMARY

According to an aspect of the invention, a patch antenna includes a substrate, a ground electrode placed on the substrate, a first patch configured to be electrically conductive and placed above the ground electrode, the first patch being formed in a ring-like shape and having an outer diameter corresponding to a first frequency to transmit a signal of the first frequency into air or receive therefrom, a second patch configured to be electrically conductive and placed above the first patch, the second patch being formed in a ring-like shape and having an outer diameter corresponding to a second frequency to transmit a signal of the second frequency into air or receive therefrom, the second frequency being higher than the first frequency, a dielectric member configured to be placed on the ground electrode and support the first patch and the second patch so as that the ground electrode, the first patch, and the second patch are arranged in parallel to each other, a first conductor configured to be formed in a cylindrical shape, the first conductor being connected to an inner edge of the first patch at one end and to the ground electrode at the other end, a second conductor configured to be formed in a cylindrical shape and arranged so as to pass through inside the first conductor, the second conductor being connected to an inner edge of the second patch at one end and to the ground electrode at the other end, a first feed line connected to the first patch at a first feed point positioned outside the inner edge of the first patch, at least part of the first feed line being a coaxial line, and a second feed line configured to pass through between the first conductor and the second conductor and be connected to the second patch at a second feed point positioned outside the inner edge of the second patch, at least part of the second feed line being a coaxial line.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Problems

In BAN, there are cases where relative positions among a plurality of human body portions, to which the communication devices are attached, change as a human body posture changes. Furthermore, it is highly probable that no other portion of a human body exists in a direction perpendicular to the human body surface. Thus, it is also highly probable that no other communication device to communicate with in BAN exists in the direction perpendicular to the human body surface. Accordingly, in a state where the antennas to be used in BAN are being attached to the human body, it is preferable that the antennas have better radiation characteristics in the direction parallel to the human body surface than the direction perpendicular to the human body surface. Furthermore, it is preferable that the antennas are not directional in the direction parallel to the human body surface. Accordingly, it is preferable that the antennas to be used in BAN have, for example, radiation characteristics similar to those of a monopole antenna installed perpendicular to the human body surface. However, such a monopole antenna has a length of at least about one-quarter of a wavelength corresponding to a frequency to be used. The length is too large to be used in the direction perpendicular to the human body surface. Therefore such a monopole antenna is not suitable for attaching to the human body. On the other hand, all the patch antennas disclosed in the foregoing patent documents are directional in a direction perpendicular to the surfaces of conductor plates. Therefore, these patch antennas are not suitable for BAN.

Hereinafter, patch antennas according to various embodiments are described with reference to the drawings. These patch antennas are patch antennas (also be referred to as microstrip antennas) usable in a plurality of frequency bands, and each include a plurality of layered patches. Furthermore, to be adapted for BAN, each of these patch antennas has radiation characteristics similar to those of a monopole antenna vertically installed with respect to a surface of the patch antenna at a radio frequency corresponding to each of the patches.

Figure 1:
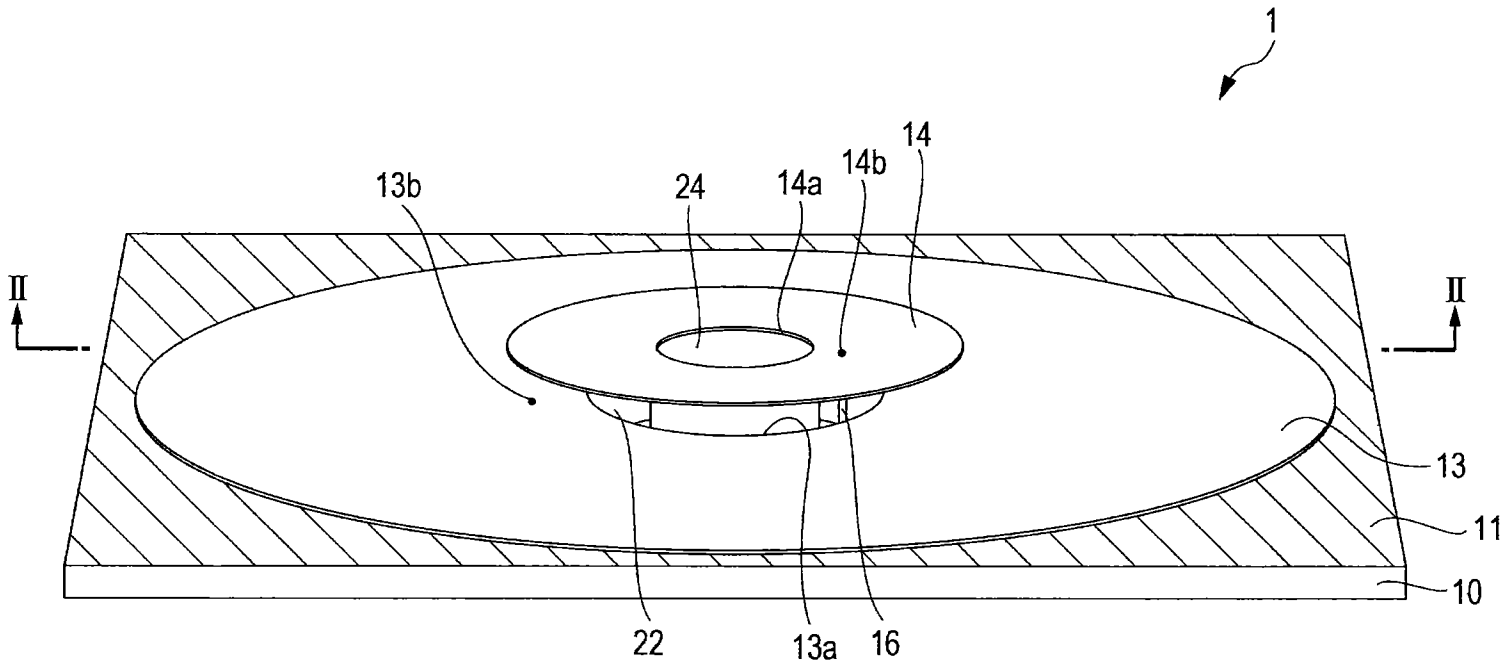
FIG. 1 is a transparent perspective view of a patch antenna according to a first embodiment.
Figure 2:
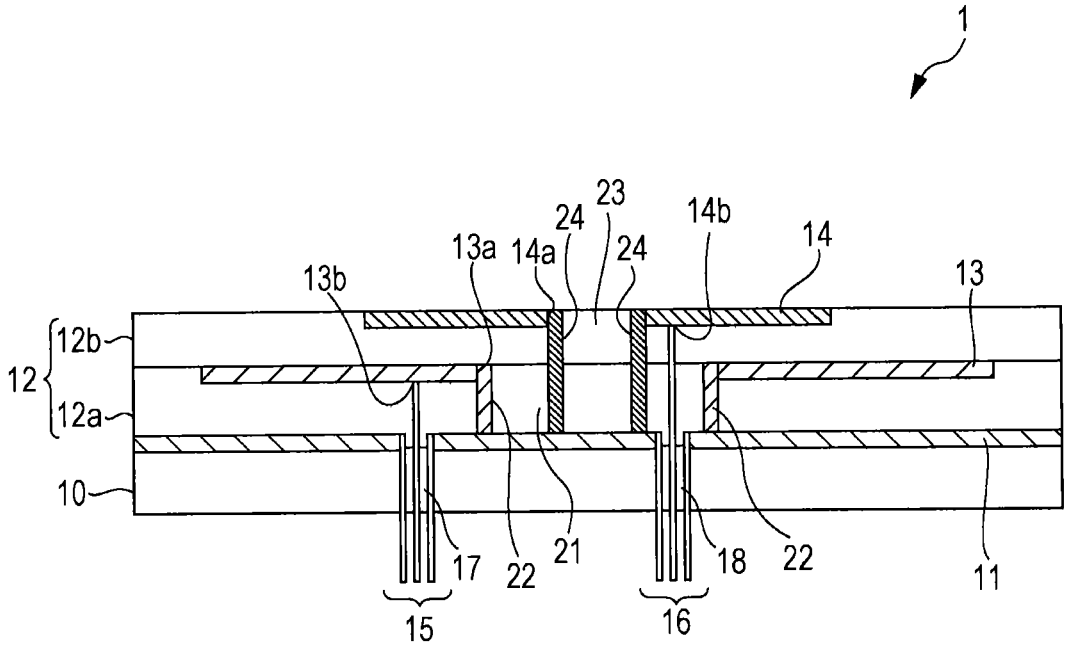
FIG. 2 is a schematic side view of the patch antenna according to the first embodiment.

FIG. 1 is a transparent perspective view of a patch antenna according to a first embodiment. FIG. 2 is a schematic side view of the patch antenna according to the first embodiment, viewed along a line II-II of FIG. 1 in an arrow direction. A patch antenna 1 includes, starting from a bottom side, a substrate 10 which is an insulator, a ground electrode 11, and two plate patches formed in ring-like shapes, namely a low frequency patch 13 and a high frequency patch 14. The patch antenna 1 further includes a dielectric member 12 that supports the low frequency patch 13 and the high frequency patch 14. The patch antenna 1 further includes a feed line 15 that feeds power to the low frequency patch 13 and a feed line 16 that feeds power to the high frequency patch 14. When the patch antenna 1 is to be used in BAN, the patch antenna 1 is attached to a human body so that a bottom side of the substrate 10 illustrated in FIG. 2 faces a surface of the human body.

The ground electrode 11 is a plate-like conductor that is grounded and provided on a top surface of the substrate 10. An area of the ground electrode 11 is larger than an area of the low frequency patch 13. Furthermore, the ground electrode 11 and the low frequency patch 13 are arranged such that the whole low frequency patch 13 is overlaid within the area of the ground electrode 11 when the patch antenna 1 is viewed from the top.

The dielectric member 12 is provided on the ground electrode 11, and supports the low frequency patch 13 and the high frequency patch 14. A thickness of the dielectric member 12 is set according to a permittivity of the dielectric member 12 so that the low frequency patch 13 and the high frequency patch 14 are allowed to function as strip antennas. In the present embodiment, the thickness of the dielectric member 12 is set to 4.5 mm.

The dielectric member 12 includes a lower layer 12*a* placed between the low frequency patch 13 and the ground electrode 11, and an upper layer 12*b* placed between the low frequency patch 13 and the high frequency patch 14. The lower layer 12*a* and the upper layer 12*b* of the dielectric member 12 are fixed on the ground electrode 11 by a screw or screws inserted into screw holes formed so as to go through the substrate 10, the ground electrode 11, the lower layer 12*a*, and the upper layer 12*b*. Alternatively, the lower layer 12*a* and the upper layer 12*b* of the dielectric member 12 may be fixed on the ground electrode 11 by any other arbitrary fixing method such as adhesion, for example.

The lower layer 12*a* has a recess on its top surface, and the low frequency patch 13 is placed in that recess. The recess has, for example, approximately the same diameter as an outer diameter of the low frequency patch 13. Furthermore, by placing the upper layer 12*b* of the dielectric member 12 on the lower frequency patch 13 and the lower layer 12*a*, the lower layer 12*a* and the upper layer 12*b* are allowed to be in contact with each other in an outer area beyond the recess, fixing the low frequency patch 13 between the lower layer 12*a* and the upper layer 12*b*.

Furthermore, at or near a center of the lower layer 12*a*, a substantially circular through hole 21 is formed along a vertical direction with a diameter approximately the same as an inner diameter of the low frequency patch 13. Along an inner wall of the through hole 21, a conductor 22 formed in a cylindrical shape is placed. Furthermore, an inside of the cylindrical conductor 22 forms an airgap. Alternatively, the conductor 22 may be filled with a dielectric material. An upper end of the conductor 22 is connected to the low frequency patch 13 while a lower end of the conductor 22 is connected to the ground electrode 11. Accordingly, the low frequency patch 13 is electrically connected to the ground electrode 11 via the conductor 22. Thus, the low frequency patch 13 functions as a ground electrode for the high frequency patch 14.

Similarly, at or near a center of the upper layer 12*b*, a substantially circular through hole 23 is formed along the vertical direction with a diameter smaller than that of the through hole 21 and approximately the same as an inner diameter of the high frequency patch 14. The through hole 23 is provided with a conductor 24 that is placed therein and formed in a cylindrical shape. An inside of the cylindrical conductor 24 forms an airgap. Alternatively, the conductor 24 may be filled with a dielectric material. An upper portion of the conductor 24 is placed along an inner wall of the through hole 23, and an upper end of the conductor 24 is connected to the high frequency patch 14. On the other hand, a lower portion of the conductor 24 extends into the through hole 21 of the lower layer 12*a* of the dielectric member 12, and a lower end of the conductor 24 is connected to the ground electrode 11. Thus, the high frequency patch 14 is electrically connected to the ground electrode 11 via the conductor 24. Furthermore, the upper layer 12*b* may also have a recess on its top surface. The recess may have substantially the same diameter as an outer diameter of the high frequency patch 14 for fixing the high frequency patch 14 therein.

The low frequency patch 13 is a conductor plate formed in a ring-like shape, and placed between the lower layer 12*a* and the upper layer 12*b* of the dielectric member 12 substantially in parallel to the ground electrode 11. The low frequency patch 13 receives a signal of a first frequency, which is a lower one of two frequencies at which the patch antenna 1 may be used, through the feed line 15 and radiates the signal into air as a radio signal. Alternatively, the low frequency patch 13 receives a radio signal of the first frequency and passes to the feed line 15 as an electric signal. To do so, the outer and inner diameters of the low frequency patch 13 are set so as to have a resonant frequency equal to the first frequency in TM01 mode. For example, when the first frequency is 950 MHz, the outer diameter of the flow frequency patch 13 is set to 62 mm. Furthermore, the low frequency patch 13 is formed in a ring-like shape, which is a point-symmetric shape with respect to the center. Accordingly, the patch antenna 1 does not have any directivity for the signal of the first frequency within a plane parallel to a surface of the patch antenna 1.

The low frequency patch 13 is connected to the feed line 15 at a feed point 13*b* placed outside an inner edge 13*a* of the low frequency patch 13. Accordingly, the low frequency patch 13 has better radiation characteristics in a direction parallel to its surface than a direction perpendicular thereto. A distance from the inner edge 13*a* to the feed point 13*b* is determined so as that at the first frequency an impedance of the low frequency patch 13 matches with an impedance of the feed line 15 at the feed point 13*b*.

The feed line 15 is connected to a communication circuit (not indicated in the drawing) through inside of the through hole 17 vertically formed in the substrate 10 and the ground electrode 11. The feed line 15 is a coaxial line path including an inner conducting wire placed at a center and an outer circumferential conductor that surrounds the inner conducting wire. Accordingly, the impedance of the feed line 15 may be easily matched with the impedance of the low frequency patch 13. Furthermore, the outer circumferential conductor of the feed line 15 is connected to the ground electrode 11, and the inner conducting wire penetrates through the lower layer 12*a* of the dielectric member 12 and is connected to the low frequency patch 13 at the feed point 13*b*.

Similarly, the high frequency patch 14 is a conductor plate formed in a ring-like shape, and placed on the top surface of the lower layer 12*a* of the dielectric member 12 substantially in parallel to the ground electrode 11 and the low frequency patch 13. Furthermore, the high frequency patch 14 is arranged so as that the centers of the high frequency patch 14 and the low frequency patch 13 are at substantially the same position, namely an outer circumference of the high frequency patch 14 and an outer circumference of the low frequency patch 13 form concentric circles. The high frequency patch 14 receives a signal of a second frequency, which is a higher one of the two frequencies at which the patch antenna 1 may be used, through the feed line 16 and radiates the signal into air as a radio signal. Alternatively, the high frequency patch 14 receives a radio signal of the second frequency and feed the radio signal to the feed line 16 as an electric signal. For such function, the outer and inner diameters of the high frequency patch 14 are set so as to have a resonant frequency equal to the second frequency. Typically, the higher the resonant frequency becomes, the smaller the outer and inner diameters of a ring-like patch become. Accordingly, the outer diameter and the inner diameter of the high frequency patch 14 are smaller than the outer diameter and the inner diameter of the low frequency patch 13, respectively. For example, when the second frequency is 2.45 GHz, the outer diameter of the high frequency patch 14 is set to 22.5 mm. Furthermore, the high frequency patch 14 is formed in a ring-like shape, similar to the low frequency patch 13. Accordingly, the patch antenna 1 does not have any directivity of the signal of the second frequency within the plane parallel to the surface of the patch antenna 1.

Furthermore, the high frequency patch 14 is connected to the feed line 16 at a feed point 14*b* placed outside an inner edge 14*a* of the high frequency patch 14. Accordingly, the high frequency patch 14 has better radiation characteristics in a direction parallel to its surface than a direction perpendicular thereto. A distance from the inner edge 14*a* to the feed point 14*b* is determined so as that an impedance of the high frequency patch 14 matches at the second frequency with an impedance of the feed line 16 at the feed point 14*b*.

The feed line 16 is connected to a communication circuit (not indicated in the drawing) through between the conductor 24 and the conductor 22, and through inside of a through hole 18 vertically formed in the substrate 10 and the ground electrode 11. As is the case for the feed line 15, the feed line 16 is a coaxial line including an inner conducting wire placed at a center and an outer circumferential conductor surrounding the inner conducting wire. Accordingly, the impedance of the feed line 16 may be easily matched with the impedance of the high frequency patch 14. Furthermore, the outer circumferential conductor of the feed line 16 is connected to the ground electrode 11. The inner conducting wire penetrates the lower layer 12*a* of the dielectric member 12 by going through the through hole 21 between the conductor 22 and the conductor 24, further penetrates through the upper layer 12*b* of the dielectric member 12, and is connected to the high frequency patch 14 at the feed point 14*b*.

It is preferable to separate the feed line 15 and the feed line 16 from each other in order that no electromagnetic interference occurs between a signal passing through the feed line 15 and a signal passing through the feed line 16. In the present embodiment, the feed line 15 and the feed line 16 are arranged such that the feed line 15, the center of an individual patch, and the feed line 16 are aligned along a straight line in order of description. Alternatively, the feed line 15 and the feed line 16 may be arranged so that a line connecting the feed line 15 and the center of the individual patch is substantially orthogonal to a line connecting the feed line 16 and the center of the individual patch. Furthermore, the feed line 15 and the feed line 16 may also be arranged so that the line connecting the feed line 15 and the center of the individual patch forms a blunt angle with the line connecting the feed line 16 and the center of the individual patch.

The ground electrode 11, the low frequency patch 13, the high frequency patch 14, and the cylindrical conductors 22, 24 may be formed of, for example, a metal such as copper, gold, silver, nickel, or an alloy thereof, or other conducting material. The dielectric member 12 may be formed of, for example, glass epoxy resin such as FR-4. Alternatively, the dielectric member 12 may be any other dielectric member which may take a layered shape.

The foregoing structure allows the patch antenna 1 to have radiation characteristics similar to those of a virtual monopole antenna vertically installed with respect to the surface of the substrate 10.

Figure 3:
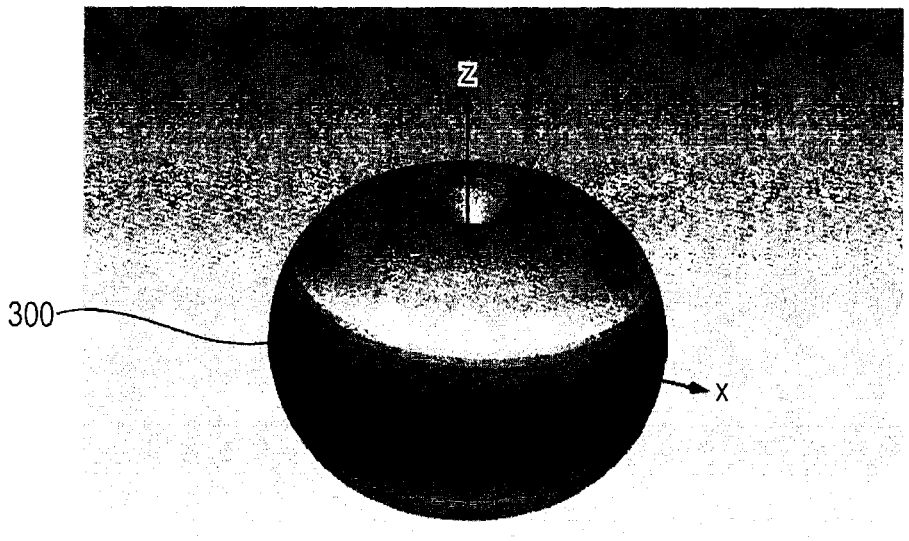
FIG. 3 is a view illustrating a simulation result of radiation characteristics of a patch antenna at 950 MHz.

FIG. 3 is a view illustrating a simulation result of the radiation characteristics of the patch antenna 1 in the TM01 mode when the first frequency is 950 MHz. In FIG. 3, the x-axis represents a direction parallel to the surface of the substrate 10, and the z-axis represents a direction perpendicular to the surface of the substrate 10. Accordingly, in a state where the patch antenna 1 is being attached on a human body, the x-axis becomes a direction substantially parallel to a human body surface while the z-axis becomes a direction substantially perpendicular to the human body surface. In a graph 300, a gain (dBi unit) of the patch antenna 1 is represented by a gray-scale image. The darker image indicates the higher gain. As is obvious from FIG. 3, in the patch antenna 1, gains along a plane parallel to the surface of the substrate 10 are higher than gains in the direction perpendicular to the surface of the substrate 10 at the frequency of 950 MHz.

Figure 4:
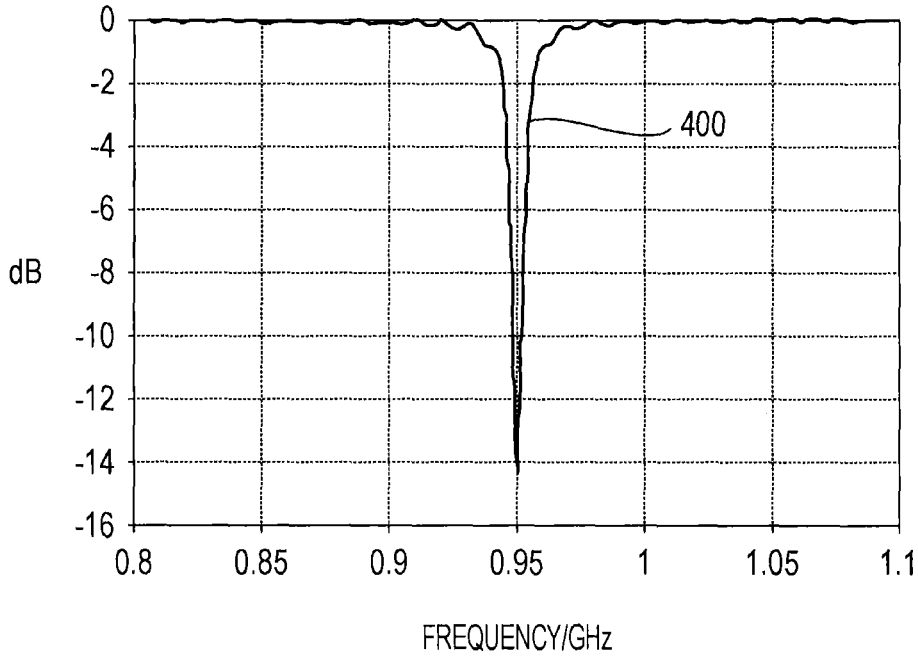
FIG. 4 is a view illustrating a simulation result of S22 parameter at 950 MHz.

FIG. 4 is a view illustrating a simulation result of S22 parameter when the first frequency is 950 MHz. In FIG. 4, the horizontal axis represents the frequency (GHz unit) and the vertical axis represents the absolute value of the S22 parameter in decibel unit. A graph 400 indicates simulation values of the S22 parameter of the patch antenna 1. As indicated in the graph 400, at 950 MHz, the value of the S22 parameter becomes equal to or less than −10 dB, which may be considered as an indication of preferable antenna characteristics.

Figure 5:
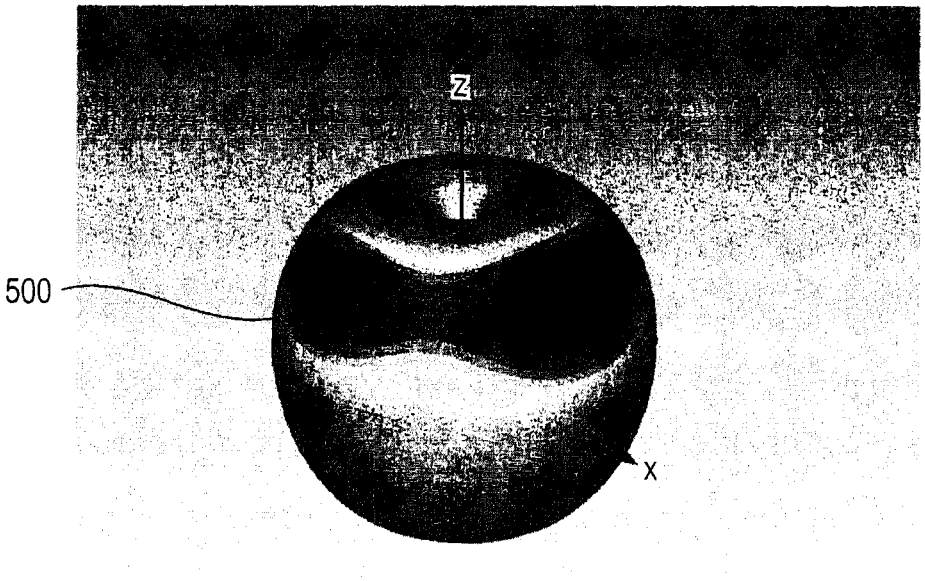
FIG. 5 is a view illustrating a simulation result of radiation characteristics of a patch antenna at 2.45 GHz.

FIG. 5 is a view illustrating a simulation result of the radiation characteristics of the patch antenna 1 in the TM01 mode when the second frequency is 2.45 GHz. In FIG. 5, the x-axis represents a direction parallel to the surface of the substrate 10, and the z-axis represents a direction perpendicular to the surface of the substrate 10. Accordingly, in a state where the patch antenna 1 is being attached on a human body, the x-axis becomes the direction substantially parallel to a human body surface while the z-axis becomes the direction substantially perpendicular to the human body surface. In a graph 500, the gain (dBi unit) of the patch antenna 1 is represented by a gray-scale image. The darker image indicates the higher gain. As is obvious from FIG. 5, in the patch antenna 1, gains along a plane parallel to the surface of the substrate 10 are higher than gains in the direction perpendicular to the surface of the substrate 10 at the frequency of 2.45 GHz.

Figure 6:
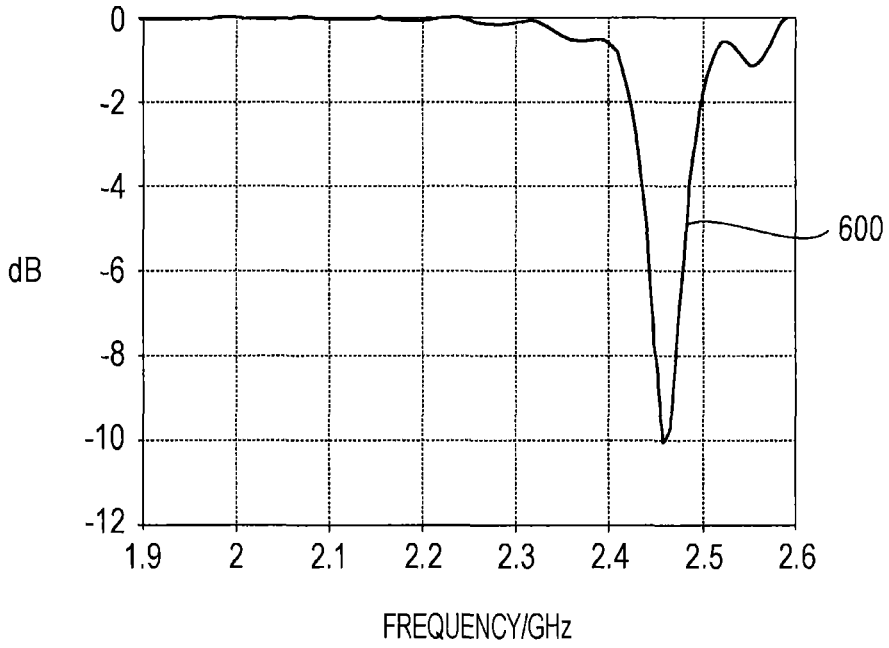
FIG. 6 is a view illustrating a simulation result of S11 parameter at 2.45 GHz.

FIG. 6 is a view illustrating a simulation result of S11 parameter when the second frequency is 2.45 GHz. In FIG. 6, the horizontal axis represents the frequency (GHz unit) and the vertical axis represents the absolute value of the S11 parameter in decibel unit. A graph 600 indicates simulation values of the S11 parameter of the patch antenna 1. As indicated in the graph 600, at 2.45 GHz, the value of the S11 parameter becomes equal to or less than −10 dB. Simulation values indicated in FIGS. 3-6 are calculated by electromagnetic field simulations that utilize a finite integration method.

As described above, this patch antenna has a smaller size in the direction perpendicular to the substrate surface and the radiation characteristics similar to those of a monopole antenna virtually installed perpendicular to the substrate surface. Thus, this patch antenna is suitable to use in BAN.

The embodiment is not limited to the one described above, and other embodiments may be formed as well. For example, in another embodiment, the patch antenna may have three or more layers of patches so as to be able to use three or more types of frequencies.

Figure 7:
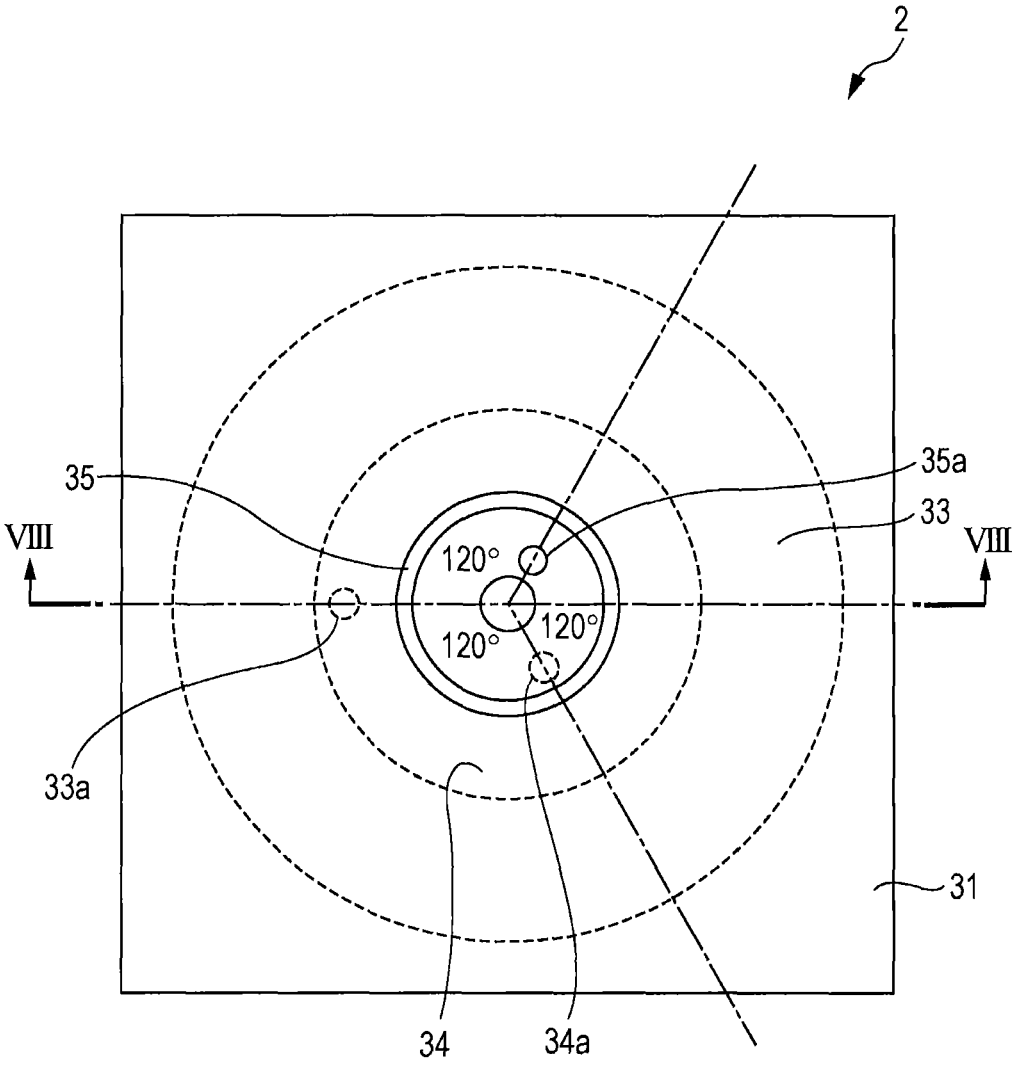
FIG. 7 is a schematic plane view of a patch antenna according to a second embodiment.
Figure 8:
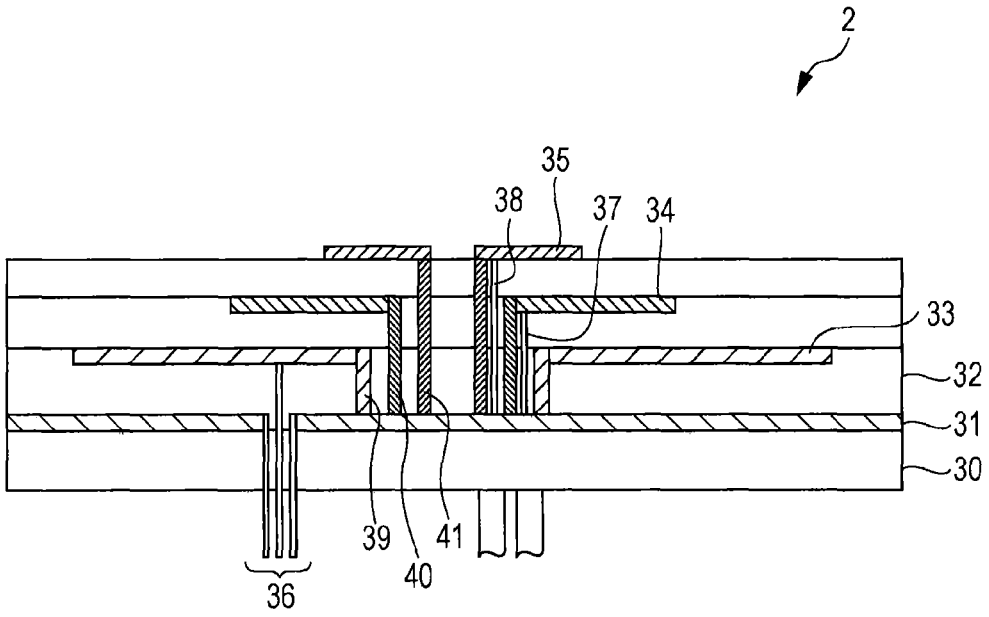
FIG. 8 is a schematic side view of the patch antenna according to the second embodiment.

FIG. 7 is a schematic plane view of a patch antenna 2 according to a second embodiment, which may be able to use three types of frequencies. FIG. 8 is a schematic side cross-sectional view of the patch antenna 2 according to the second embodiment, viewed along a line VIII-VIII of FIG. 7 in an arrow direction. The patch antenna 2 includes, starting from a bottom side, a substrate 30 which is an insulator, a ground electrode 31, and a dielectric member 32. Furthermore, the patch antenna 2 includes, starting from a bottom side, a low frequency patch 33 and a middle frequency patch 34 both placed inside the dielectric member 32, and a high frequency patch 35 provided on a top surface of the dielectric member 32. Furthermore, the patch antenna 2 includes feed lines 36-38 that feed signals the respective patches 33-35. When the patch antenna 2 is used in BAN, the patch antenna 2 is attached to a human body so as that a bottom side of the substrate 30 in FIG. 8 faces a human body surface.

As is the case with the first embodiment, the patches 33-35 are each a conductor plate formed in a ring-like shape, and are layered in parallel to the ground electrode 31. The patches 33-35 are arranged such that their centers are at substantially the same position. The patch 33 placed on the lowest side corresponds to a first frequency (for example, 440 MHz), which is the lowest of the three types of frequencies which the patch antenna 2 may use. The patch 34 corresponds to a second frequency (for example, 950 MHz), which is the middle of the three types of frequencies which the patch antenna 2 may use. The patch 35 placed on the top side corresponds to a third frequency (for example, 2.45 GHz), which is the highest of the three types of frequencies which the patch antenna 2 may use. Outer and inner diameters of the patches 33-35 are set so as that the frequency of a transmitting signal or a receiving signal for each of the patches 33-35 becomes equal to its resonant frequency. Accordingly, the outer diameter and the inner diameter of the patch 33 are the largest ones, and the outer diameter and the inner diameter of the patch 35 are the smallest ones.

The patches 33-35 are connected to respective upper ends of cylindrical conductors 39-41 at inner edges of the patches 33-35, and lower ends of the cylindrical conductors 39-41 are in contact with the ground electrode 31. Thus, the patches 33-35 are electrically connected to the ground electrode 31 via their respective inner edges. Furthermore, the patch 33 is connected to an inner conducting wire of the feed line 36, which is a coaxial line path, at a feed point 33*a* positioned outside the inner edge of the patch 33. Similarly, the patch 34 is connected to an inner conducting wire of the feed line 37, which is a coaxial line path, at a feed point 34*a* positioned outside the inner edge of the patch 34. Furthermore, the patch 35 is connected to an inner conducting wire of the feed line 38, which is a coaxial line path, at a feed point 35*a* positioned outside the inner edge of the patch 35. Outer circumferential conductors of the coaxial line paths included in the feed lines 36-38 are each connected to the ground electrode 31. The feed point 33*a* and the feed line 36 are arranged so as that their positions are outside the inner edge of the patch 33, and allow impedances of the feed line 36 and the patch 33 to be matched at the first frequency. Furthermore, the inner conducting wire of the feed line 37 is arranged so as to go through between the conductor 39 and the conductor 40. The feed point 34*a* to which the feed line 37 connects is arranged so as that its position is outside the inner edge of the patch 34 and inside the inner edge of the patch 33, and allows impedances of the feed line 37 and the patch 34 to be matched at the second frequency. Similarly, the inner conducting wire of the feed line 38 is arranged so as to go through between the conductor 40 and the conductor 41. The feed point 35*a* to which the feed line 38 connects is arranged so as that its position is outside the inner edge of the patch 35 and inside the inner edge of the patch 34, and allows impedances of the feed line 38 and the patch 35 to be matched at the third frequency.

To reduce possibility of having electromagnetic interference among signals passing through the feed lines 36-38, the feed lines 36-38 and the feed points 33*a*-35*a* are arranged so as that each of three lines respectively connecting the feed lines 36-38 and the center of an individual patch makes an angle of 120° with another one of the three lines. Alternatively, the feed lines 36-38 may be arranged so as that two of the feed lines 36-38 are aligned along a line with having the center of the individual patch in between, and the line connecting these two of the feed line 36-38 is orthogonal to a line connecting the remaining one of the feed lines 36-38 and the center of the individual patch.

The patch antenna 2 according to the second embodiment may be able to use the three types of frequencies by having the foregoing structure. Furthermore, the patch antenna 2 also has the radiation characteristics similar to those of a virtual monopole antenna vertically installed with respect to the surface of the substrate 30 at the first, second, and third frequency. Furthermore, in the patch antenna 2, a height from the ground electrode 31 to the patch 35 on the top side is about several mm or less. Thus, the patch antenna 2 has a small vertical size. Accordingly, the patch antenna 2 is suitable to use in BAN.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A patch antenna comprising:

a substrate;

a ground electrode placed on the substrate;

a first patch configured to be electrically conductive and placed above the ground electrode, the first patch being formed in a ring-like shape and having an outer diameter corresponding to a first frequency to transmit a signal of the first frequency into air or receive therefrom;

a second patch configured to be electrically conductive and placed above the first patch, the second patch being formed in a ring-like shape and having an outer diameter corresponding to a second frequency to transmit a signal of the second frequency into air or receive therefrom, the second frequency being higher than the first frequency;

a dielectric member configured to be placed on the ground electrode and support the first patch and the second patch so as that the ground electrode, the first patch, and the second patch are arranged in parallel to each other;

a first conductor configured to be formed in a cylindrical shape, the first conductor being connected to an inner edge of the first patch at one end and to the ground electrode at the other end;

a second conductor configured to be formed in a cylindrical shape and arranged so as to pass through inside the first conductor, the second conductor being connected to an inner edge of the second patch at one end and to the ground electrode at the other end;

a first feed line connected to the first patch at a first feed point positioned outside the inner edge of the first patch, at least part of the first feed line being a coaxial line; and a second feed line configured to pass through between the first conductor and the second conductor and be connected to the second patch at a second feed point positioned outside the inner edge of the second patch, at least part of the second feed line being a coaxial line.

2. The patch antenna according to claim 1, wherein the first feed line and the second feed line are arranged so as that the first feed line, a center of the first patch, and the second feed line are linearly aligned in order of description.

3. The patch antenna according to claim 1, wherein the first feed line and the second feed line are arranged so as that a first line connecting the first feed line and a center of the first patch and a second line connecting the second feed line and the center of the first patch are orthogonal to each other.

4. The patch antenna according to claim 1, further comprising:

a third patch configured to be electrically conductive and placed above the second patch, the third patch being formed in a ring-like shape and having an outer diameter corresponding to a third frequency to transmit a signal of the third frequency into air or receive therefrom, the third frequency being higher than the second frequency;

a third conductor configured to be formed in a cylindrical shape and arranged so as to pass through inside the second conductor, the third conductor being connected to an inner edge of the third patch at one end and to the ground electrode at the other end; and a third feed line configured to pass through between the second conductor and the third conductor and be connected to the third patch at a third feed point positioned outside the inner edge of the third patch, at least part of the third feed line being a coaxial line path.

* * * * *